United States Patent [19]

Li

[11] 3,994,428

[45] *Nov. 30, 1976

[54] APPARATUS FOR MAKING REINFORCED METAL-MATRIX COMPOSITES

[76] Inventor: Chou H. Li, 379 Elm Drive, Roslyn, N.Y. 11576

[ * ] Notice: The portion of the term of this patent subsequent to June 24, 1992, has been disclaimed.

[22] Filed: June 20, 1975

[21] Appl. No.: 588,970

Related U.S. Application Data

[63] Continuation-in-part of Ser. No. 250,195, May 4, 1972, Pat. No. 3,890,690, which is a continuation-in-part of Ser. No. 769,938, Oct. 23, 1968, Pat. No. 3,663,356.

[52] U.S. Cl. ..... 228/18; 228/176; 228/190; 156/619; 164/276; 425/76; 118/491; 118/73; 118/620

[51] Int. Cl.² ..... B05C 3/15; B32B 15/02; B24K 19/00

[58] Field of Search ..... 228/190, 18, 176; 29/419, 191.4, 191.6; 156/608, 619; 164/87, 276; 264/167; 425/6, 76; 118/49, 49.1, 73, 620

[56] References Cited

UNITED STATES PATENTS

| | | | |
|---|---|---|---|
| 2,953,427 | 9/1960 | Egger | 264/167 |
| 3,084,421 | 4/1963 | McDaniels et al. | 29/419 X |
| 3,098,723 | 7/1963 | Micks | 29/191.6 X |
| 3,153,279 | 10/1964 | Chessin | 29/191.6 X |
| 3,165,826 | 1/1965 | Bentov | 29/419 |
| 3,243,339 | 3/1966 | Scragg et al. | 425/76 |
| 3,301,643 | 1/1967 | Cannon et al. | 29/191.6 X |
| 3,337,337 | 8/1967 | Weeton et al. | 29/419 X |
| 3,427,185 | 2/1969 | Cheathan et al. | 29/191.6 X |
| 3,434,827 | 3/1969 | Lemkey | 75/134 H |
| 3,540,517 | 5/1968 | Wojcik et al. | 164/87 |
| 3,689,328 | 9/1972 | Perona | 29/191.6 X |
| 3,698,863 | 10/1972 | Roberts et al. | 29/191.6 X |
| 3,890,690 | 6/1975 | Li | 29/419 X |

*Primary Examiner*—Al Lawrence Smith
*Assistant Examiner*—K.J. Ramsey

[57] ABSTRACT

This invention discloses the structure of, and the method and apparatus for making, improved metal-matrix composites. Each of the composites comprises a strain-hardenable metal matrix, and a plurality of high-strength, high-modulus, elongated reinforcing members arranged in spatial relationship therein. Each of the members is effectively bonded to the surrounding matrix at selected, discrete surface regions along its length so as to locally strain the matrix around the discretely bonded regions upon the composite being suitably stressed. When thus locally strained, the matrix is spatially selectively and differentially strain-hardened and strengthened near the bonded regions. The spheres of influence of the straining and strain-hardening in the matrix near the bonded regions on one member are caused to significantly overlap similar spheres of influence near the neighboring members. This composite structure substantially increases mechanical interaction and load transfer ability between the members because of the intervening hardened and strengthened matrix.

32 Claims, 8 Drawing Figures

APPARATUS FOR MAKING REINFORCED METAL-MATRIX COMPOSITES

CROSS-REFERENCE TO RELATED APPLICATIONS:

This is a continuation-in-part of my pending application Ser. No. 250,195, filed on May 4, 1972, now U.S. Pat. No. 3,890,690. This pending application was, in turn, a continuation-in-part of its pending application Ser. No. 769,938, filed Oct. 23, 1968, now U.S. Pat. No. 3,663,356.

BACKGROUND OF THE INVENTION

This invention relates to reinforced metal-matrix composites and apparatus for their manufacture, and more particularly, to composites comprised of strain-hardenable metal-matrix with elongated reinforcing members dispersed therein and held in position thereby, but selectively and differentially bonded thereto.

Laboratory tests have shown that metal-matrix composites, compared with metals, glasses, ceramics, plastics, etc., offer weight saving in aerospace or other structures of up to 45 percent or more. Composites with reinforcing members made of graphite, ceramics, or other refractory compounds promise to have high strengths, high modulii, and long-life, high-temperature capabilities. A list of matrix metals already employed includes aluminum, magnesium, titanium, beryllium, iron, copper, silver, molybdenum, and nickel. The materials of the reinforcing members also have varied from boron, beryllium, graphite, sapphire, silicon carbide, boron carbide, to stainless steel.

Composite samples have been made which possess ultimate tensile strengths of over 147 ksi and compressive strengths of 300 ksi, but not much ductility. Unfortunately, the field of metal-matrix composites is still backward. The advaces made so far have largely been empirically based. Different production methods have been used. Such methods include vapor deposition, diffusion or roll bonding, liquid metal infiltration, unidirectional melt growth, powder metallury, electroforming, draw cladding, and plasma spraying. However, all are beset by major manufacturing problems. The magnitude of these problems has been almost universally considered to be insurmountable for the next few years.

Foremost among these problems is the difficulty of developing optimum bonding between the matrix and fibers or reinforcing members. The bonding interfaces apparently play a very significant part, if not the key role, in the determination of the resultant composite properties. Thus, observed composite failures mostly occur at or near the matrix-fiber interfaces. It is generally considered that a uniformly strong bonding is essential to the reinforcing mechanism. Too strong bonding, however, appears to cause the composite to be severely limited by the matrix. It is also thought that the fibers must completely wet the matrix (see, e.g., Wainer in U.S. Pat. No. 3,282,658); yet, when this occurs, chemical reactions, interdiffusions, or intermetallic compound formations often result, which cause severe chemical degradations or even destructions of the reinforcing fibers. Other problems with most present composite manufacturing include:

1. fiber nonalignment exceeding 3°;

2. physical or chemical degradation of the fibers, due to processing or reaction with the matrix; and
3. improper control of fiber distribution in the composites.

SUMMARY OF THE INVENTION:

Accordingly, the objects of the invention are:

1. To overcome the aforementioned manufacturing problems and disadvantages of prior-art composites comprised of the usual high-strength, high-modulus reinforcing members embedded in the usual strain-hardenable metal matrices;
2. To provide improved reinforced, metal-matrix composites even with the same matrix and reinforcing materials and production method;
3. To achieve reproducible alignment and distribution of the reinforcing members in the composites;
4. To obtain optimum combination and structure of physical and chemical bonding between the matrix and fibers for controlled load-transfer characteristics between the fibers, and for improved overall performance of the composites;
5. To provide means to control the chemical bonding, reaction, or diffusion between the fibers and the matrix so as to reliably achieve high composite strength;
6. To provide unique, transverse protrusions or ridges on the reinforcing members to achieve novel, and useful physical and/or chemical results;
7. To control and relieve mismatch stresses and strains between the matrix and the fibers;
8. To provide means to increase the resistance of the fibers to transverse dynamic stresses and strains;
9. To improve the life and reliability of high-temperature metal-matrix composites; and
10. To disclose novel processes and equipment to manufacture composites having the above-described desirable properties.

Further objects and advantages of my invention will appear as the specification proceeds.

DESCRIPTION OF THE DRAWINGS

The preferred form of my invention is illustrated in the accompanying drawing in which.

DESCRIPTION OF THE PREFERRED EMBODIMENTS

Figure 1:
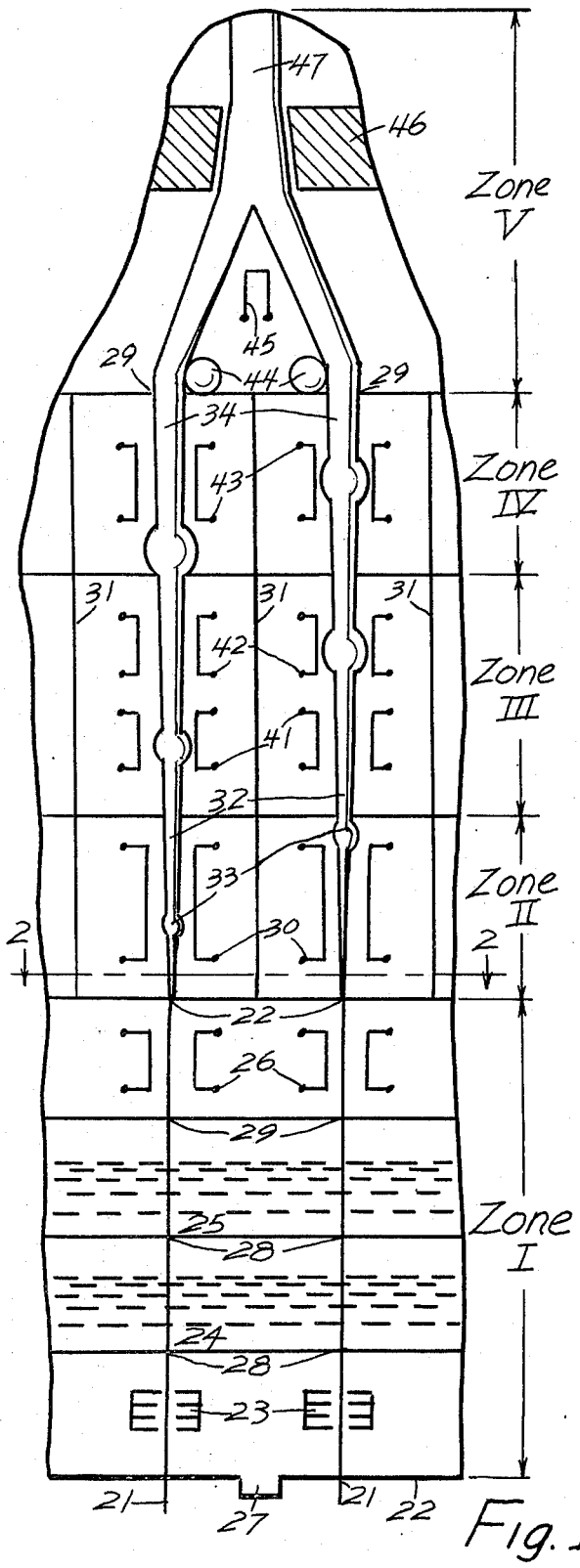
FIG. 1 is a front view showing a portion of the inside of a composite-making apparatus according to the invention.
Figure 2:
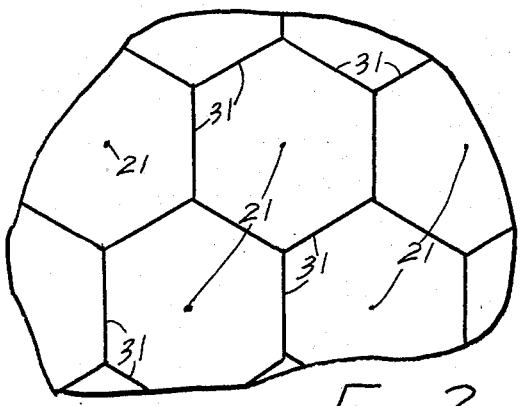
FIG. 2 is a top view of the above apparatus taken along the cross-sectional line 2—2 of FIG. 1.

With reference to the drawing, there is shown in FIG. 1 one form of the apparatus for producing the metal-matrix composites according to the method of the invention. Here, a number of parallel, fine tungsten, tantalum, or other metallic or non-metallic supporting wires 21 are arranged by means of guides 22 in a substantially uniform and equispaced, triangular or hexagonal pattern, such as is seen in FIG. 2. Metallic wires, however, are generally easier to handle and, further, allow the passage of electrical currents therein for heating or electroplating. These wires are pulled from their respective spools (not shown) at their lower end vertically upward at fairly uniform speeds to pass through a number of processing zones, i.e., Zones I to V, as shown. The preferred vertical movements eliminate gravity effects and result in symmetrical and uniform deposits or surface treatments to be discussed.

Zone I is for wires preparation and may include such processing steps as mechanical cleaning by brushes or scrubbers 23, chemical cleaning including degreasing by organics 24 and oxide removal by acids 25, and vacuum cleaning such as vacuum heating by heaters 26 and/or ion bombardment. It is evident that suitable dust removal means (ducts) 27, liquid seals 28, vacuum locks 29, fluid inlets and outlets, instruments, heating and pressurizing means, etc., must be provided for these operations.

Zone II is for depositing the reinforcing metallic or non-metallic materials 32 by chemical or vacuum vapor deposition from suitable sources 30. Other depositing methods include electroplating or pulling the supporting wires through a bath of suitable molten materials. Preferably, each wire has its own deposition chamber, such as is outlined by partitions 31, so that the deposition thereon can be adjusted and controlled independently of the deposition on the other wires. According to one aspect of the invention, the depositing conditions are periodically changed, such as by varying the degree of energization on the sources 30, or, in other cases, the plating or heating currents in the supporting wires, or the temperature and chemicals concentrations in the deposition chambers. These periodic changes in deposition conditions cause periodic variations in the deposition rates resulting, at constant supporting wires traveling speed, in transverse protrusions 33 being regularly and purposedly formed on the wires. The shape, size and position of these protrusions on each wire can be independently programmed and controlled in a predetermined manner, account being taken of the shape, size, and position of similar protrusions on the neighboring wires. For most uses, these protrusions should be equal in size and shape, but zigzag from one wire toward its neighbors along a longitudinal direction of the wires as shown in FIG. 1. After passing through the deposition zone, or Zone II, the wires become reinforcing threadlike fibers, and covered thereon with the required amount of reinforcing materials 32, such as B, Be, SiC, sapphire, or graphite.

In Zone III, the reinforcing fibers receive their post-deposition treatments, which may simply be a rinsing treatment after electroplating, or vacuum and/or thermal degassing, or, as shown, heating by heaters 41 to promote diffusional bonds between the supporting wires 21 and deposited reinforcing materials 32. The fibers may also receive other special treatments in Zone III. For example, in one such treatment, the reinforcing fibers are passed through sponges of proper sizes and elasticity and in proper spaced arrangement and, furthermore, wetted with a solution of chemical bondpromoting materials to improve the chemical bonding between the matrix and the reinforcing materials 32. A metallizing solution of molybdenum or tungsten oxide, for example, molybdenum trioxide, is particularly useful for promoting chemical bonding to metal matrices by many ceramic reinforcing fibers such as sapphire, beryllia, and graphite, or by many metallic reinforcing fibers (such as Ti or stainless steel) having non-metallic oxides or other refractory materials on the surfaces. It is to be noted that these chemical bond-promoting materials are applied only to the protruded portions of the reinforcing members by the sponge technique described above. On fibers without protrusions, these chemical bond-promoters may be applied to selected portions on the fibers by, e.g., periodically compressing the wet sponges against the fibers, or by using suitable sources 42 of the bond-promoting materials together with masks, shutters, or programmed periodic source energizers. Greases, oils, or other special materials contained in these same sponges or sources may also be applied as masks or shields only to selected portions so that only portions between these selected portions are now susceptable to a subsequent treatment. This treatment may comprise applying a surface layer by chemical reaction or electrodeposition to prevent wetting and to reduce chemical bonding between the matrix and the non-protruded portions. Another post-deposition treatment in Zone III may be to apply, either selectively or uniformly, a soft, metallic (Cu, Ni, or A1) cushioning surface layer of substantial thickness to increase the resistance of the reinforcing members to transverse and dynamic stresses and strains.

The reinforcing fibers prepared in the above manner may be used as such according to conventional fiber-matrix integration techniques, such as pressing, liquid infiltration, extrusion, and the like. However, according to another aspect of the invention, the reinforcing members or fibers coming out of Zone III are passed directly into Zone IV for the application, as a part of a continuous process, of the relatively soft and plastic, but strain-hardenable metal matrix 34 (such as the usual Al, Mg, Ti, Be, Fe, Cu, Ag, Ni, Mo mentioned before) thereon, by liquid penetration, electroplating, vapor or vacuum deposition such as from the sources 43 as shown. Special shields, and liquid, vapor, or vacuum locks, matrix metal sources, etc., may be required here, but these are also easily designed by persons skilled in the art.

The last zone, i.e., Zone V, is for final preparation, which may include such steps as mechanical or chemical cleaning of the matrix-deposited reinforcing members; densification by extrusion or pressing; thermal treatments (for degassing and controlling the grain-size of the matrix or fiber material, or for promoting bonding only at selected areas between matrix and reinforcing fibers); conditioning the composite including strain-hardening selective portions of the matrix; and packaging. In FIG. 1, the reinforcing fibers with the matrix metal vacuum-deposited thereon from the deposition sources 43 are seen to be guided by guides 44 to pass through a heating zone heated by heaters 45 into densifying die 46. Finished composite 47 then comes out of the exit end of the densifying die 46. This densifying die may be simply an extrusion die.

In summary, in the preferred mode described above, metallic or non-metallic supporting wires 21 are prepared in Zone I of the equipment of FIG. 1 by mechanical, chemical, and vacuum-thermal means. The prepared wires then enter into Zone II for deposition of the reinforcing material 32, and preferably also for formation of the spaced protrusions 33 thereon at the same time. Zone III is for such post-deposition treatments as rinsing, vacuum degassing, or thermal treatments. Another useful treatment is the application of soft cushioning layer, or a chemical bond promoting or reducing (TiC or Ti) layer by a sponge technique. Zone IV is for the deposition of the matrix metal 34 on the reinforcing member. The "final preparation" Zone V may be designed for cleaning, densifying, heating, conditioning, packaging, and/or the like.

The above scheme completely solves the persistent problems of improper fiber alignment and distribution. Each reinforcing fiber now has exactly six closest neighbors in the above scheme at substantially the same distances apart. This results in substantially balanced transverse forces on each fiber from its neighboring fibers, thereby avoiding fiber breakage. It also avoids, on the one hand, too much spacing between reinforcing fibers so that the efficiency of mechanical interactions or load transfer between them is impaired or nullified and, on the other hand, too closely-spaced fibers so that the full strain-hardening effect of the matrix surrounding the fibers is not achieved therby resulting in failure of the intervening matrix because of localized high stresses and strains. Full strain-hardening of the matrix, according to this invention, is achieved when there are present therein large, controlled, regularly-spaced, and preferably uniformly-shaped, strain-hardened zones of continually increasing straining intensity toward the chemically bonded portions on the fibers.

It is to be particularly noted that in the above example, the bonding between each fiber and its surrounding matrix varies in a systematic, predetermined manner periodically along the length of the fiber, e.g., the bonding may be alternately physical and chemical along the fiber. The periodic distance is determined by the distance between two neighboring, similarly bonded portions on the fiber or, in the case of protruded fibers, the distance between two neighboring protrusions on the same fiber.

The protrusions achieve many novel and important purposes: Firstly, they effectively and selectively strain and strain-harden the surrounding matrix. Thus, they raise the load that can be transferred between the fibers through the intervening strengthened matrix, and yet, they still provide relatively soft and ductile regions in the composite. This achieves a new and useful result, which is particularly evident in the matrix located among oppositely compressing or shearing protrusions on neighboring fibers (see Fig. 4). Secondly, the protrusions facilitate and simplify the proper (zigzaggered) packing of the fibers or the regulation and control of differential bonding between the matrix and fibers, described above as an essential feature of my new mode or principle of composite reinforcing mechanism. Thirdly, the protrusions prevent the reinforcing members from being pulled out of the composite particualrly at high temperatures. Fourthly, the protrusions provide bearing areas so that the load transfer between fibers is not limited to interfacial shears that tend to break the fiber-matrix bonds, but is also at least partly taken up by compressions, to which type of stress the matrix has much greater resistance to failure than shear. Fifthly, according to another aspect of the invention, only surfaces of the protrusions on the fibers are chemically bonded to the matrix so that, the non-protruded portions on the fibers are prevented from chemically reacting or diffusing with the matrix. In general, such chemical reactions or diffusions follow well-known diffusion laws so that for a given system under a specified service (temperature) conditions, the time to penetrate a given depth is roughly proportional to the square of the diameter. Since the protruded portions have diameters of, typically two to three times the fiber diameter, the time to penetrate and fail at the protruded portions is about four to nine times greater than at the non-protruded portions. That is, by having protrusions on the reinforcing fibers and limiting chemical bonding only to the protruded portions, the high-temperature life of the composite will often be increased manyfold.

The protrusions should generally have no sharp edges or corners that may act as stress raisers. Each of the protrusions may have a shape symmetrical with respect to a plane normal to the fiber, or have no such symmetrical shape with respect to every such plane. In some cases, protrusions having non-symmetrical shapes are desirable so that the load transfer efficiency from one fiber to its neighbors in one of the longitudinal directions is substantially higher than that in the other direction. It is also desirable to have the direction of high load transfer efficiency alternate from one fiber to its neighbors, such as is shown in FIG. **4*b*** with the tensile forces indicated thereon. These arrangements achieve the oppositely compressing and shearing, and the resultant great strain-hardening effects on the matrix.

The protrusions should not be too large in sizes because then the thin fibers are frequently subjected to large bending stresses from loads applied on the flanges of the protrusions. Neither should the protrusions be too small, or the beneficial effect of protrusions is not fully exploited. For optimum results, these protrusions should have diameters of about 1.5 to 6 times those of the fibers. Since each protrusion must optimally interact not only with protrusions on neighboring fibers, but also with those on the same fiber, the spacing of the protrusions on the fiber should be between 3 to 15 times the protrusion diameters, otherwise such interactions become negligible or insignificant. On the other hand, too closely spaced protrusions on the fiber, such as less than three times protrusion diameter, result in too small and insufficiently developed strain-hardened zones in the matrix. For similar reasons, the spacing between nearest protrusions on two neighboring, reinforcing fibers in the composite should roughly be between three to ten times protrusion diameter for optimal results, since it is also somewhat dependent on the height of the protrusions relative to the fiber diameters. The best size of protrusions or spacings between protrusions or fibers, varies from instance to instance, dependent also on the strain-hardening behavior of the matrix.

The optimum volume percentage of reinforcing fibers can be determined according to the following rule to achieve optimal strength by insuring equal failure rates in the fibers and in the surrounding strain-hardened matrix. Thus, the effective area of the hardened and strengthened matrix in the strain-hardened zone surrounding the fiber (at the chemically bonded or protruded portions) multiplied by the ultimate tensile strength of the strain-hardened matrix should equal the cross-sectional area of the reinforcing fibers, or at the non-protruded portions thereon if protrusions are present, multiplied by the ultimate tensile strength of the fibers.

Each of the reinforcing fibers in the above example comprises a metallic or non-metallic wire core 21 for support, and an outer layer of the reinforcing material 32. This material may have the same composition as the core so that the boundary between the core and the outer layer may be physically or chemically indistinguishable. If, in addition, the core material is single-crystalline, under suitable growth conditions (See Li: Physica Status Solidi 15, 3, 1966), the outer layer can also be made single-crystalline and crystallographically indistinguishable from the core, thereby resulting in single-crystalline fibers.

Even commercially available fibers or other reinforcing members may be used to practice this invention. These fibers may be AlN, $Al_2O_3$, B, $B_4C$, Be, BeO, C, graphite, Mo, SiC, $Si_3N_4$, steel, $TiB_2$, TiC, TiN, W, WC, zirconia. These fibers, selectively surface-contoured to provide the protrusions thereon (by, e.g., etching), and/or coated with bond-affecting chemicals (such as Cr and Ca, Sr, Ba, or Mg of Wainer in U.S. Pat. No. 3,282,658), are fed directly into Zone IV or V of the equipment of FIG. 1, thereby simplifying the euqipment by eliminating the Zones I to III or IV. Schmechenbecher fibers (U.S. Pat. No. 2,978,323) comprising Fe and Ni wires carbonyl surface coated with B, Ti, Si, P, As may be similarly treated and used here. Gruber's pure SiC fibers (U.S. Pat. No. 3,246,950) prepared by gaseous reaction of silicon monoxide and carbon monoxide, preferably between 1300–1600° C, can also be treated according to this invention for incorporation into Al, Fe, Co, Ni, W, Mo matrix materials by powder metallurgy or other techniques.

Single-crystalline fibers or whiskers can also be grown without the use of core wires at all. This has been done by unidirectional eutectic melt growth (See Kraft's Al—$CuAl_2$ and Cr—$Cr_{23}C_6$ in Trans. AIME 221, 95, 1961 and 227, 380, 1963; or Kraft U.S. Pat. No. 3,124,452; Weiss U.S. Pat. Nos. 3,226,225 and 3,267,405; Lemkey U.S. Pat. No. 3,434,827; Heimke U.S. Pat. No. 3,434,892; and Müller U.S. Pat. No. 3,442,823). Another method comprises nucleating with, e.g., a special catalytic impurity vacuum-deposited on a substrate according to a hexagonal pattern; growing the whiskers by chemical or vapor depositions, from chemical solutions, by electroplating, or otherwise such as by the vapor-liquid-solid growth mechanism (See Li, Phys. Stat. Solidi 15, 445, 1966); and possibly even keeping the whiskers aligned by mechanical pulling or electrostatic means.

In the equipment of FIG. 1, the method of manufacturing the metal matrix reinforced composite involves three distinct steps, i.e., preparing the fibers, dispersing the fibers in the matrix, and selectively bonding the fibers to the matrix. In melt eutectic growth, these three steps are simultaneously achieved in a single operation. Some other controlled chemical phase transformations, such as peritectic, monotectic, or eutectoid reactions of metals can be similarly useful. These chemical phase transformations involve in each case three distinct phases capable of establishing thermodynamic equilibrium at a transformation temperature. The phase transformation is to occur at this transformation temperature, and at least one of the three phases preferably is a liquid or gaseous phase so that the transformation is not limited by the slow solid diffusions.

One can even produce lateral protrusions desired on the eutectic fibers or sheets for this invention by reducing the growth temperature and/or growth rate, suddenly, in accordance to Hanson (U.S. Pat. No. 2,988,433), Dermatis (U.S. Pat. No. 3,162,507), Bennett (U.S. Pat. No. 3,031,403), or Sirtl (U.S. Pat. No. 3,344,002). Sirtl achieved controlled thickening of dendrite ribbon shaped monocrystals of III–V or II–VI compounds and simultaneous doping by changing growth temperature, temperature gradient, or concentration gradient. The doping agent can be selectively segregated at discrete regions on the reinforcing fibers or sheets, according to their segregation coefficients, so as to selectively affect the matrix bonding properties at these regions. The segregated doping agent, if preferentially oxidizable over the matrix metal, e.g., Al over Fe or Ni, will reduce the bonding strength at these regions or prevent chemical bonding altogether thereat. Thus, in melt eutectic growth with sudden and periodic variations in melt temperature, withdrawal rate, or temperature gradient, we can not only produce protrusions and achieve differential chemical bonding, but position the selectively bonded discrete regions relative to the protrusions. The procedure invloves adding to the original melt a chemical bond-promoting or bond-inhibiting, melt-segregatable impurity and allowing the impurity to segregate on the protrusions or other selected portions of the melt-grown fibers or sheets. Care should be taken to adjust the growth conditions in relation to eutectic solidification and impurity segregation as determined by the relevant phase diagrams.

Figure 3:
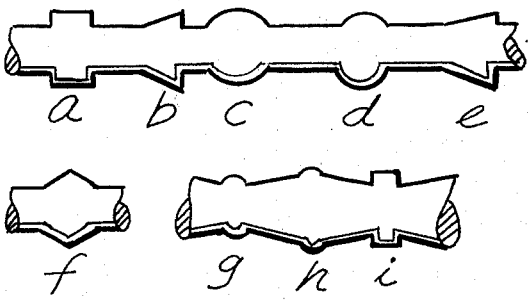
FIG. 3 shows the presence of protrusions or ridges, and their various shapes, on the reinforcing members.

FIG. 3 shows three basic forms or shapes of the protrusions or ridges on the reinforcing members. These forms are: square wave (3a), triangular wave (3b), and elliptical wave (3c). These forms can also be distorted, e.g., the distorted partial ellipse (3d) and distorted square (3e). The last form (3e) can also be considered as a combination of the square and triangular forms. Other combination forms include two oppositely tapering or triangular forms (3f), tapering with superposed ellipse (3g and 3h), and tapering with superimposed square (3i).

Figure 4:
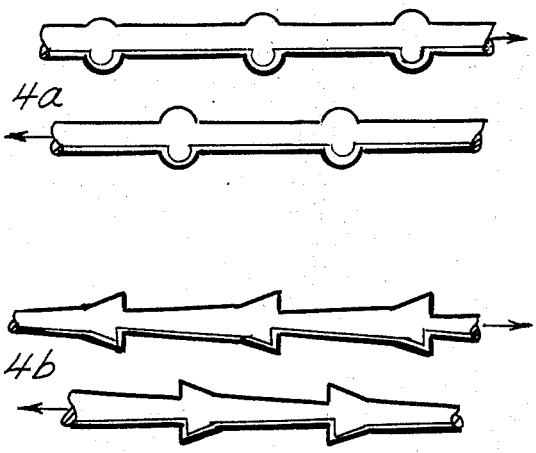
FIG. 4 shows the arrangements of the reinforcing members with their associated protrusions thereon for obtaining optimum reinforcing effects in the composites.

FIG. 4 shows two arrangements whereby neighboring reinforcing members of the protruded type are arranged to achieve oppositely compressing and/or shearing effects on the intervening matrix. When a reinforced composite of this invention is loaded, some pairs of neighboring members must be oppositely tensioned, and the situation depicted in or similar to FIG. 4 always results. FIG. 4*a* is a useful arrangement in which the load-transfer efficiency is independent of the direction of the tensile forces, i.e., whether as shown or oppositely directed. On the other hand, in the arrangement of FIG. 4*b*, the same efficiency depends on the direction of tensile forces on the reinforcing members. Notice that here these members have combination protrusions, i.e., triangular protrusions on tapering bases. Further, for each member the direction of easy load transfer on the triangular protrusion is directly opposite to that for the tapering base. Specifically, the triangular protrusions cause the top member of FIG. 4*b* to have high load transfer efficiency if this member is pulled to the right as is indicated, but the tapering base has low load transfer efficiency for the same pulling force on the same top member of FIG. 4*b*.

When a composite with protruded reinforcing members dispersed therein is subjected to mechanical working, such as rolling or extrusion, differential bonding between the members and matrix occurs. Further, such mechanical operations can be regulated so that the character and degree of bonding, and the shape, size, and spacing of the bonded portions can be controlled and programmed. Also, not only is the bonding better and more chemical in the protruded portions than in the non-protruded portions but, on the same protrusion, the side first coming out of the rolling or extrusion die is better bonded than the other side. When the mechanical working or area reduction is sufficiently severe, such as between 40 to 100 percent of the allowable straining and strain-hardening without failing the matrix; and when the straining is sufficiently rapid, i.e., if the rolling or extruding speed is comparable with or exceeds the thermal diffusion rate in the matrix, then substantial chemical bonding results from the almost adiabatic heating by heat converted from the plastic deformation work. The composite with protruded reinforcing members dispersed therein and coming out of the extrusion die 46 of FIG. 1 can, therefore, be selectively and differentially bonded, either physically or chemically, in respect to the bonding between the members and matrix, if suitable processing procedures are adopted. However, if the reinforcing material 32 or matrix metal 34 is easily or heavily oxidized, then special chemical bond-promoters are desirable to insure positive bonding.

Even with the extruded or rolled composites containing nodulated members, differential bonding is further intensifed upon application of load on the composite. Rolling and extruding do strain-harden and strengthen the matrix metal around the nodules, but according to a different type of force system and resulting in a different spatial straining pattern. This is because the forces in rolling and extrusion are predominantly lateral, rather than longitudinal as usually occurs during service of the composites. That is, the extruded or rolled composites containing nodulated reinforcing members go through additional processes of matrix differential straining and strain-hardening, upon loads application of the composites.

It is to be reemphasized that composites according to the present invention achieve high load-transfer efficiencies between the reinforcing members and matrix through comtrolled, selective and differential straining and strain-hardening of the matrix, a natural result of regulated, selective and differential bonding between the matrix and the reinforcing members dispersed therein. Such a reinforcing mechanism is completely different from those involved in fiber glasses or reinforced concretes. In these materials, the matrix is not strain-hardenable and, in contrast to the composites herein disclosed, merely acts as glue in fiberglasses while carries practically all the load in reinforced concretes. In both these cases, the load transfer between the reinforcing members is limited by the low shear strengths of the unchanging, relatively weak matrices. Further, reinforced concrete cannot stand high temperatures and thermal or mechanical shocks, partly because there is no soft matrix regions for the absorption of thermoplastic mismatch stresses and strains. Also, in reinforced concrete with ribbed steel rods, the stresses are highly concentrated at only a few protruded areas, again because of no matrix yielding. On the other hand, in my new composites, external service load is successively and gradually taken up by increasingly strain-hardened individual or discrete matrix regions, until all such regions (in the space between protrusions on neighboring members) are assuming nearly equal shares of the load. The localized stresses cannot exceed the matrix yield stress because of selective matrix yielding. Such a self-regulated, load or stress distribution is absent in any of these materials.

Even prior-art composites of the metal-matrix type greatly differ from my composites in structure, result, and mode of operation, because the former lack controlled and optimum strengthening of the matrix, protrusions on the reinforcing members, regulated differential bondings, alternate chemical and physical bondings, intentionally imperfect chemical bondings at periodic intervals to relieve mismatch stresses and strains, and the like.

All fibers or sheets in existing metal-matrix composites are not smooth; some even have uncontrollable and undesirable surface roughnesses. Still, the bondings of these members to the matrix are neither selective nor controlled. The bonded regions are neither substantially equal-spaced, now similar-shaped, nor zigzagging on neighboring members. Above all, the transverse thickness variations in these members are not sufficiently great, i.e., less than 50percent of the minimum thickness of the member, and the protrusions are of improper shape and spacing. The result is that the metal matrix is not substantially strain-hardened and strengthened, and the spheres of influence induced by the straining and hardening do not significantly overlap to achieve substantially increased mechanical interaction and load transfer ability, even if these member otherwise completely followed the principle of this invention.

It is to be particularly noted that in my composites the load transfer is not directly from one reinforcing member to another, but indirectly through the intervening strain-hardened and strengthened matrix. Further, the strain-hardening and strengthening in the matrix is not to be abrupt (such as is obtained by many other methods of composite manufacture including soldering, brazing, and spot welding the fibers together), but gradually varies in intensity, both laterally and longitudinally, reaching maximum values at near the centers of the chemically bonded matrix-member interfaces. Also, the matrix metal is alternatley hard and soft along the length of each discretely bonded member, hard where strength is needed to insure efficient load transfer from member to member while soft where some ductility is required to allow stress and strain relief.

The invention is not to be construed as limited to the particular forms disclosed herein, since these are to be regarded as illustrative rather than restrictive. Thus, while it is possible to achieve most or all of the ten objectives of the invention with the equipment and process disclosed herein, merely applying the differential bonding principle of composite reinforcement allows one to achieve a few of the stated objectives (e.g., high load transfer, great strength, simultaneously and with either nodulated or non-nodulated reinforcing members. Also, composites may have only a portion of the reinforcing members differentially bonded to the matrix, to achieve partial benefits.

Figure 5:
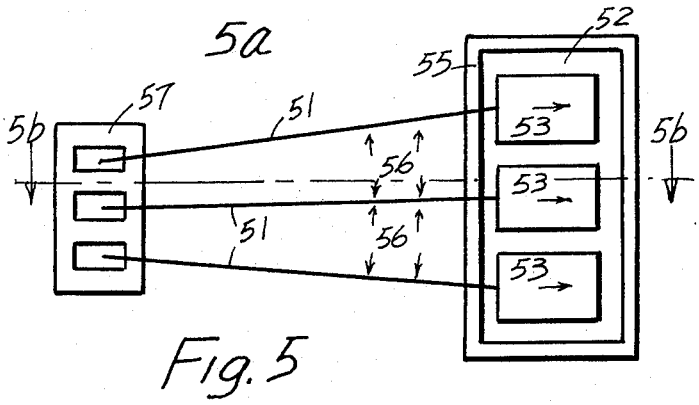
FIGS. 5 to 8 show other apparatus for making the composites.

FIGS. 5 to 8 show some other preferred equipments for making the rod or sheet type of reinforcing members with protrusions, i.e., nodules or ridges. FIG. 5*a* is a top view of a fiber growth apparatus by the spinning disc-in-melt method. Here, a quantity of the material of the reinforcing members 52 is melted by, e.g., electrical heating (not shown) in a suitable container 55. One or more of the fast-rotating (over 100 rpm) discs 53 have their lower portions dipped into the melt 52, by amounts just enough to centrifuge out from the melt a substantially continuous, liquid thread or sheet 51 of the proper thickness. Upon quenching by air cooling or, preferably, cooling to subatmospheric temperatures by, e.g., liquid nitrogen jets 56, the molten threads or sheets 51 instantaneously freeze into reinforcing fibers, rods, or sheets. Fast quenching is desirable because it enhances the mechanical properties of the resultant reinforcing members. These members are then fed by the guides 57 to the matrix integration equipment, such as Zone IV of FIG. 1. The quench zone or chamber in FIG. 5 is separated from the hot melt 52 by insulation materials 54 consisting, for example, of stacked but separated, multiple 0.002 refractory tantalum or tungsten sheets. The quenching liquid nitrogen jets 56 also cools the top portions of the rotating wheels 53 for their reinsertion into the melt 52 to repeat the process. The wheels 53 may have notches or valleys on their circumferences to produce nodulated or ridged reinforcing members. During their transit toward matrix integration, these members may be coated with bond-modifiers or cushioning layers of the previously described types.

Figure 6:
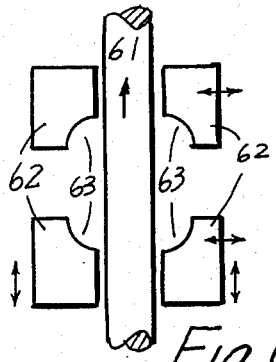

In FIG. 6, a reinforcing member 61 (fiber or sheet) is pulled through the set of half dies 62. Each half die is split in the middle to periodically grab and release the travelling, reinforcing member 61, through the horizontal motions shown by the horizontal arrows. The half dies 62 are also periodically and longitudinally movable relative to each other, as shown by the vertical arrows along the lower half dies. In operation, the traveling reinforcing members 61 are periodically grabbed firmly by the two half dies 62. After grabbing, the dies move close to each other so as to form the protrusions according to the design of the voids 63 in the half dies.

Figure 7:
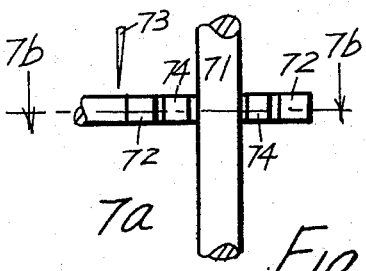

In FIG. 7, a traveling reinforcing member 71 is periodically fed sidewise by a feeding mechanism 72 to form a ring of the same or different reinforcing material in wire form. The fed wire is cut by knife 73 and the feed mechanism 72 immediately closes on the fed wire loop to crimp the loop rigidly onto the traveling reinforcing member 71. Alternately, a welding current may be passed from the feeding mechanism 72 through the fed wire loop 74 to the reinforcing member 71, to form a more positive joint between the wire loop and the reinforcing member. In either case, a (periodically) protruded reinforcing member is produced.

Sheets with nodules or ridges can be similarly produced on the equipments of FIGS. 6 and 7. Further, the nodulated or protruded reinforcing members can be fed directly to, e.g., the extrusion die 46 of FIG. 1 together with matrix sheets for making the composites.

Figure 8:
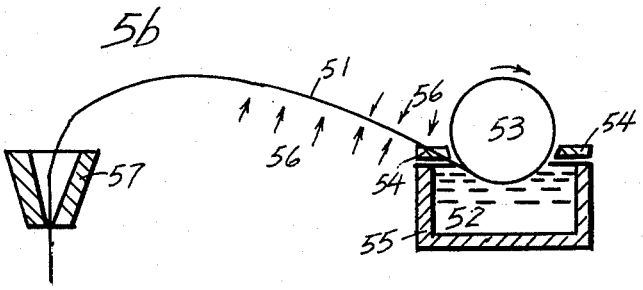
Figure 8:
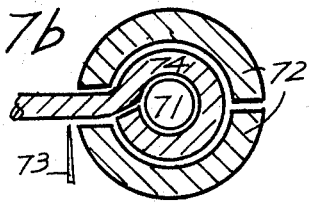
Figure 8:
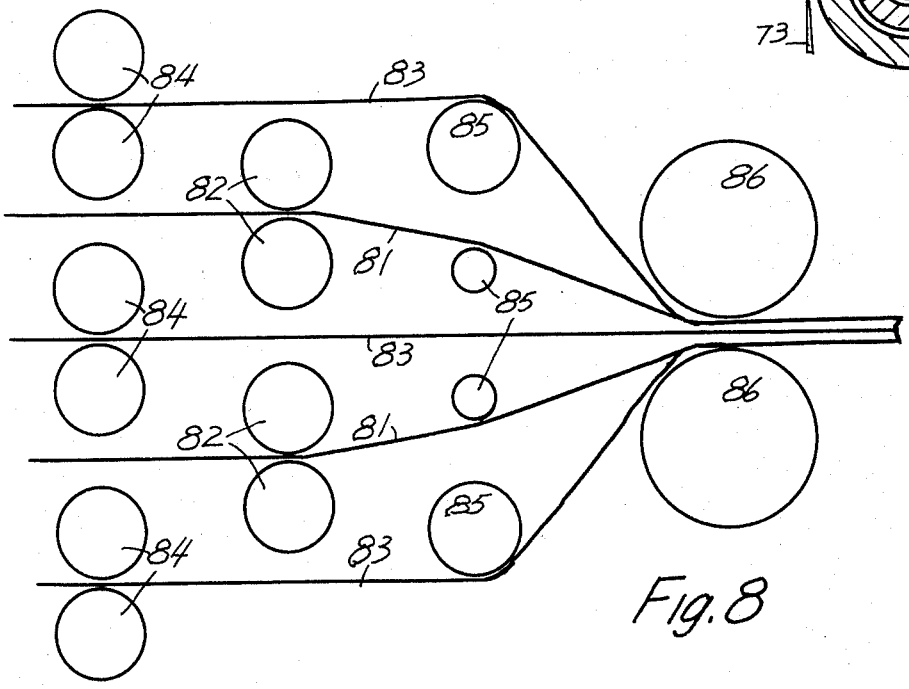

FIG. 8 show a series of rolls 82 designed to roll down the thickness of the reinforcing members 81 while simultaneously form the protrusions thereon. The diameters, distances, void designs, on the roll surface, and rotational speeds of the rolls must be carefully coordinated so that each roll contributes substantially to the formation of the protrusions. Preferably, the first or first few rolls should be hot rolls to facilitate the thickness reduction and the formation of the protrusions while the last or last few rolls should be cold rolls to enhance the strength and stiffness of the reinforcing members. Sheet metal matrix materials 83 are fed through other rolls 84 and guides 85 and simultaneously with the protruded reinforcing members to the compacting and integrating extrusion rolls 86 for making the composites in a single-step operation. The apparatus thus allows mass producing the composites at low cost. A single roll may even be possible for handling each reinforcing member or matrix strip, as is shown in FIG. 8.

I claim:

1. Apparatus for making reinforced, metal-matrix composite having a plurality of elongated, high-strength and high-modulus reinforcing members dispersed in spatial relationship in a strain-hardenable metal matrix, comprising: means for effectively bonding the members to the surrounding matrix at selected, discrete surface regions along their lengths; and means for stressing the composite sufficiently to locally strain the matrix near the discretely bonded regions wherely the matrix in the space between the members is substantially and selectively though nonuniformly strain-hardened and strengthened and whereby spheres of influence induced by the straining and strain-hardening in the matrix within the space near the discrete surface regions on one member are caused to significantly overlap similar spheres of influence near the neighboring members so as to substantially increase mechanical interaction and load transfer ability between the one member and the neighboring members through the intervening hardened and strengthened matrix.

2. The apparatus as in claim 1 wherein the bonding means comprises a eutectic melt growth equipment.

3. The apparatus as in claim 1 including means for applying a metallic, cushioning layer of substantial thickness on the surface of the reinforcing members before their being effectively bonded to the matrix.

4. The apparatus as in claim 1 including means for forming protrusions on the members and centering the selected regions on the protrusions.

5. The apparatus as in claim 1 wherein the stressing means comprises means for mechanically working the composite to achieve at least 40 percent of the allowable straining and strain-hardening in the matrix without the failure thereof.

6. The apparatus as in claim 5 wherein the mechanical working means is of the type which works the composite at a rate sufficiently fast relative to the heat dissipation rate in the composite so that substantial chemical bonding occurs from the relatively confined heat generated from the plastic deformation of the matrix through the mechanical work.

7. The apparatus as in claim 1 including means for preparing the reinforcing members; means for dispersing the members in the matrix according to the spatial relationship; and means for periodically forming along the length of the members protrusions having sufficient sizes to significantly affect the overlapping of the spheres of influences around adjacent members.

8. The apparatus as in claim 7 wherein the preparaing and dispersing means are of the types which accomplish the preparing and dispersing operations with the members in vertical positions to eliminate gravity-related, processing non-uniformity effects.

9. The apparatus as in claim 7 wherein the protrusion forming means comprises means for periodically varying the forming conditions so as to form the protrusions periodically along the length of the reinforcing members.

10. The apparatus as in claim 7 is of the type which wherein the bonding means chemically bonds the reinforcing members to the surrounding matrix, and including means for modifying the surface chemical bonding characteristics of the reinforcing members relative to the matrix thereby chemically bonding the members to only the protrusions on the members.

11. The apparatus as in claim 7 including means for applying at each of the non-protruded portion of the members a protective inert layer to prevent the portion from chemically bonding to and reacting with the surrounding matrix.

12. An apparatus as in claim 7 wherein the protrusions forming means is of the type which systematically changes at least one of such protrusions forming parameters as forming rate, forming temperature, temperature gradient, and material supply rate.

13. An apparatus as in claim 12 wherein the protrusions forming means is of the type which regulates in a predetermined manner the shape, size, and position of the protrusions on each of the members independently of the forming conditions on the neighboring members.

14. An apparatus as in claim 1 including means for feeding stocks of the matrix and reinforcing member materials; and means for incorporating the members into the matrix and for achieving the selective bonding therebetween.

15. An apparatus as in claim 14 wherein the feed stock of the reinforcing member material is of substantially uniform section thickness and including means for forming transverse protrusions thereon before its being fed into the incorporating means.

16. An apparatus as in claim 1 including means for forming the reinforcing members, said forming means being in the form of a spinning disc-in-melt system with the spinning disc rotating at over 100 rpm.

17. An apparatus as in claim 16 wherein the spinning disc has spaced-apart notches of controlled sizes on the circumference thereof so as to form transverse protrusions on the spun-out reinforcing members.

18. An apparatus as in claim 16 including means for applying fluid quenching jets onto the spun-out and at least partly molten, reinforcing material streams to thereby instantly freeze and quench the material streams into the reinforcing members.

19. An apparatus as in claim 1 for making composite in which at least one of the matrix and reinforcing member materials is electrically conductive and including means for longitudinally passing electrical current through the conductive material.

20. An apparatus as in claim 1 including means for feeding supporting wires to form the cores of the members; means for preparing the fed supporting wires; means for depositing reinforcing material onto the prepared supporting wires to thereby form the members; means for depositing the matrix metal onto the members; and means for integrating the matrix metal coated members into the composite.

21. An apparatus as in claim 1 wherein the bonding means is of the type which bonds the members to the matrix in a systematic, predetermined manner periodically along the length of the members.

22. An apparatus as in claim 1 wherein the bonding means is of the type which alternately physically and chemically bonds to the matrix consecutive surface portions of each of the members.

23. An apparatus as in claim 1 wherein the bonding means comprises a phase transformation equipment including a container for containing three distinct material phases capable of establishing thermodynamic equilibrium at a fixed transformation temperature; and means for maintaining at least portion of the contained material phases at the fixed transformation temperature to cause the transformation to proceed at the fixed temperature thereby transforming at least one of the three phases into the matrix and members and also dispersing the members in, and selectively bonding the members to, the matrix in a single operation.

24. An apparatus as in claim 23 wherein the phase transformation equipment is of the type which achieves at least one of the phase transformations including eutectic, eutectoid, peritectic, and monotectic reactions.

25. An apparatus as in claim 1 wherein the stressing means is of the type which forms controlled, regularly-spaced and uniformly-shaped, strain-hardened zones of continually increasing straining intensity toward the discretely bonded surface regions.

26. An apparatus as in claim 1 wherein the stressing means is of the type which substantially and selectively strains and strain hardens the matrix surrounding the selected and discretely bonded, surface regions on the members while still provides relatively soft and ductile zones in the matrix located between the surface regions.

27. An apparatus as in claim 1 including means for dispersing the members in the matrix according to the spatial relationship.

28. An apparatus as in claim 27 wherein the reinforcing members are discontinuous members and the dispersing means comprises means for aligning the discontinuous members to within 3° of a common longitudinal direction.

29. An apparatus as in claim 27 for making composite in which the members are substantially parallel fibers and wherein the dispersing means comprises means for parallelly distributing the fibers in the matrix in such a manner that each fiber has six nearest neighbors located at a substantially constant, first common distance therefrom.

30. An apparatus as in claim 29 wherein the distributing means is of the type which distributes the fibers so that each fiber also has six second nearest neighbors located at a substantially constant, second common distance therefrom.

31. An apparatus as in claim 27 for making composite in which the members have substantially equal-sized and similar-shaped, transverse protrusions of substantial heights and uniformly spaced along the members, the transverse thickness variations of the members being at least 50 percent of the minimum member thickness, and the dispersing means is of the type which distributes the members in the matrix so that the protrusions zigzag from one member toward its neighbors along a longitudinal direction of the members.

32. The apparatus as in claim 31 wherein the stressing means comprises means for oppositely compressing and shearing the zigzagged protrusions on the nearby members.

* * * * *

UNITED STATES PATENT OFFICE

CERTIFICATE OF CORRECTION

Patent No. 3,994,428 Dated Nov. 30, 1976

Inventor(s) Chou H. Li

It is certified that error appears in the above-identified patent and that said Letters Patent are hereby corrected as shown below:

Column 12, lines 62-63, "is of the type which wherein the bonding means" should read --wherein the bonding means is of the type which--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*